US005322223A

United States Patent [19]

Hadar

[11] Patent Number: 5,322,223

[45] Date of Patent: Jun. 21, 1994

[54] STATIC SECTOR-TYPE WATER SPRINKLER

[75] Inventor: Yoram Hadar, Haifa, Israel

[73] Assignee: Lego M. Lemelshtrich Ltd., Natania, Israel

[21] Appl. No.: 49,379

[22] Filed: Apr. 21, 1993

Related U.S. Application Data

[63] Continuation-in-part of Ser. No. 801,133, Dec. 2, 1991, Pat. No. 5,205,491.

[30] Foreign Application Priority Data

Dec. 5, 1990 [IL] Israel ..... 96547
Apr. 7, 1993 [IL] Israel ..... 105335

[51] Int. Cl.[5] ..... B05B 1/32
[52] U.S. Cl. ..... 239/457; 239/598; 239/581.2; 239/DIG. 1
[58] Field of Search ..... 239/200, 201, 451, 455-458, 239/460, 581.1, 581.2, 582.1, 538, 539, 597, 598, DIG. 1

[56] References Cited

U.S. PATENT DOCUMENTS

| | | | |
|---|---|---|---|
| 4,119,275 | 10/1978 | Hunter | 239/DIG. 1 |
| 4,184,239 | 1/1980 | Clawson | 29/157 C |
| 4,189,099 | 2/1980 | Bruninga | 239/200 |
| 4,579,285 | 4/1986 | Hunter | 239/457 |
| 4,625,917 | 12/1986 | Torney | 239/DIG. 1 |
| 4,739,934 | 4/1988 | Gewelber | 239/DIG. 1 |
| 4,850,538 | 7/1989 | Krahn | 239/439 |
| 5,058,806 | 10/1991 | Rupar | 239/206 |
| 5,083,709 | 1/1992 | Iwanowski | 239/DIG. 1 |

*Primary Examiner*—Karen B. Merritt
*Attorney, Agent, or Firm*—Benjamin J. Barish

[57] ABSTRACT

A static, sector-type water sprinkler producing a variable-sector water-distribution pattern includes an outlet opening in the form of a helical slot having an effective length around the circumference of its housing which may be varied for preselecting the sector angle of the water distribution around the sprinkler, and a blocking member engageable with the inner surface of the housing on opposite sides of the slot to preselect the portion thereof to be unblocked and thereby the sector angle of the water distribution around the sprinkler.

20 Claims, 2 Drawing Sheets

STATIC SECTOR-TYPE WATER SPRINKLER

RELATED APPLICATION

The present application is a continuation-in-part of my prior patent application Ser. No. 07/801,133 filed Dec. 2, 1991, now U.S. Pat. No. 5,205,491.

FIELD AND BACKGROUND OF THE INVENTION

The present invention relates to water sprinklers, and particularly to a static, sector-type water sprinkler producing a variable-sector water-distribution pattern around the sprinkler.

My U.S. Pat. No. 5,205,491 discloses a static, sector-type water sprinkler of this type including a housing formed with an inlet opening at one end connectible to a supply of pressurized water, and an outlet opening having an effective length around the circumference of the housing which may be varied for preselecting the sector angle of the water distribution around the sprinkler; characterized in that the outlet opening is defined by a slot extending helically around substantially the complete circumference of the housing; and in that the sprinkler further includes a blocking member movable with respect to the slot to preselect the portion thereof to be unblocked by the blocking member, and thereby the sector angle of the water distribution around the sprinkler.

According to further features in the preferred embodiment of the invention described in that application, the blocking member is disposed within a cylindrical bore extending axially of the housing and is rotatable therein to preselect the portion of the slot to be unblocked, and thereby the sector angle of the water distribution around the sprinkler. More particularly, the outer face of the blocking member is formed with a helical rib receivable in the helical slot to preselect the portion of the slot to be unblocked according to the rotated position of the blocking member and its helical rib.

BRIEF SUMMARY OF THE PRESENT INVENTION

The present invention provides an improvement in the sprinkler of that patent application, characterized in that the blocking member includes an outer face formed with a cylindrical surface having an outer diameter substantially equal to the diameter of the part of the bore in the housing communicating with the helical slot so as to be engageable with the inner surface of the housing on opposite sides of the slot to preselect the portion thereof to be unblocked by the blocking member and thereby the sector angle of the water distribution around the sprinkler.

According to further features in the preferred embodiment of the described herein, the blocking member is further formed with a helical rib receivable in a second helical slot in the inner surface of the housing and effective to move an edge of the cylindrical surface of the blocking member over the inner surface of the housing on opposite sides of the helical slot to thereby preselect the portion of the helical slot to be unblocked by the blocking member. The respective edge of the cylindrical surface is angled with respect to the longitudinal axis of the housing and has axially offset ends.

It has been found that a sprinkler constructed in accordance with the foregoing features provides a better seal against leakage or discharge of water from the sprinkler except at the unblocked portion of the slot.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
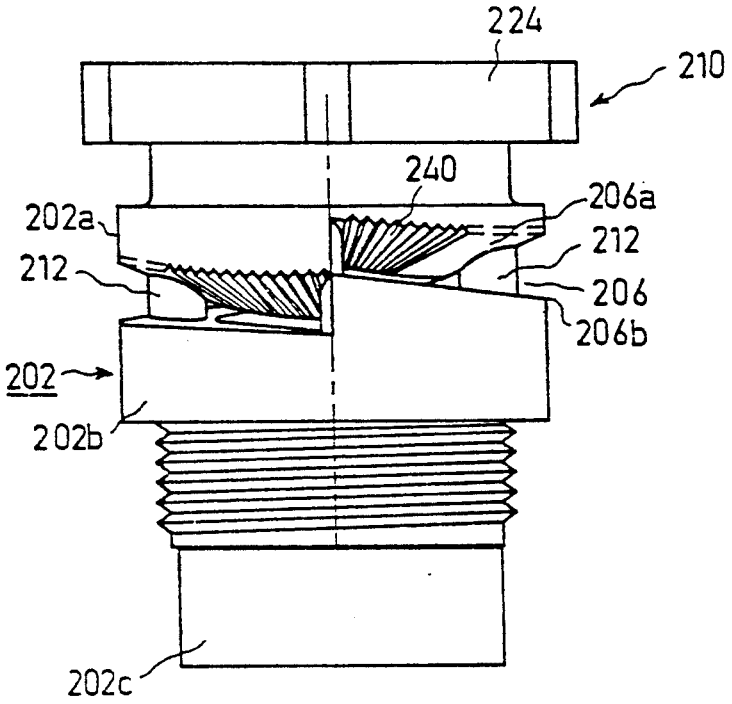
FIG. 1 is a side elevational view illustrating one form of sprinkler constructed in accordance with the present invention.
Figure 2:
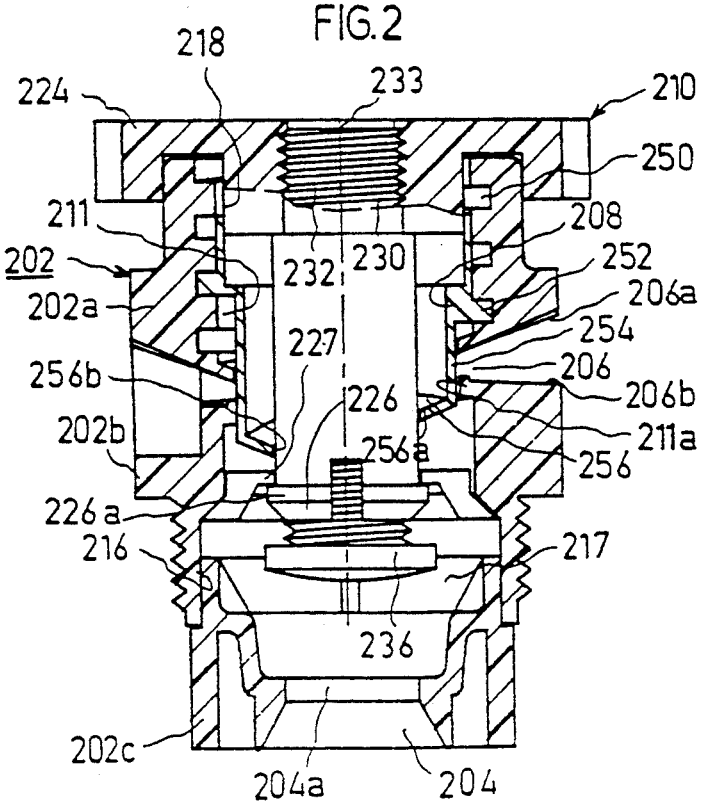
FIG. 2 is a longitudinal sectional view of FIG. 1.
Figure 3:
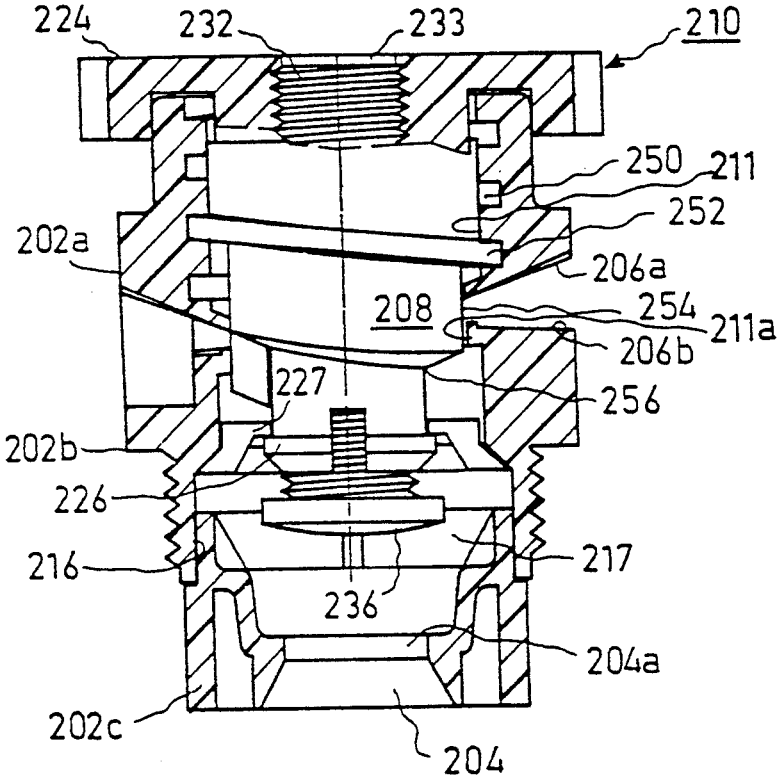
FIG. 3 is a view similar to that of FIG. 2 but illustrating the outer appearance of the inner blocking member included in the sprinkler of FIG. 1.

The sprinkler illustrated in the drawings is a static-sector-type water sprinkler of basically the same construction as described in my U.S. Pat. No. 5,205,491 but includes an improvement as will be described more particularly below. To facilitate understanding, those elements which generally correspond to the sprinkler described in that patent application carry the same reference numeral except increased by "200", whereas the generally new elements carry reference numerals starting with "250".

The illustrated sprinkler comprises a housing 202 formed with an inlet opening 204 at one end connectible to a supply of pressurized water, and a helical slot 206 extending through and helically around the circumference of the housing to serve as an outlet opening for discharging the water around the sprinkler. Helical slot 206 is of fixed length, but the length of the slot effective to discharge the water may be varied by a blocking member 208. Blocking member 208 is manually movable with respect to the slot to preselect the portion thereof to be unblocked by the blocking member, and thereby the sector angle of the water distribution around the sprinkler.

Presetting the sector is effected by a manually-rotatable stem assembly, generally designated 210, which may be rotated to thereby rotate the blocking member 208. Housing 202 is formed with an axially-extending bore 211 for receiving the stem assembly 210.

More particularly, housing 202 is constituted of three sections 202*a*, 202*b* and 202*c*. Housing section 202*a* defines the upper surface 206*a* of the helical slot 206, whereas housing section 202*b* defines the lower surface 206*b* of the helical slot. The two sections 202*a*, 202*b*, with the blocking member 208 in between, are secured together by a plurality of posts 212 formed in the lower surface of housing section 202*a* received within blind bores in housing section 202*b*. Housing section 202*c* is integrally formed with inlet opening 204 and is secured to housing section 202*b* by a friction fit, wherein the smooth outer surface 216 in housing section 202*c* is frictionally received within the smooth inner surface in the lower end of housing section 202*b*. Housing section 202*b* is formed with recesses 217 on its inner surface which define flow passageways from the inlet 204 to the blocking member 208.

Blocking member 208 is of generally cylindrical configuration to be snugly received within the two housing sections 202*a*, 202*b* when secured together. The blocking member is formed with a central axially-extending bore 218 of non-circular (e.g., hexagonal) configuration.

Stem assembly 210 includes a hollow stem 222 of the same cross-section (e.g., hexagonal) as axial bore 218 in blocking member 208 so as to be non-rotatably receivable within the blocking member. Assembly 210 further includes a circular collar 224 at one end of stem 222, and a split tip 226 at the opposite end of the stem formed with an annular rib 226*a*. The outer end of collar 224 forms an externally-accessible finger-gripping element permitting stem 222, as well as blocking member 208 received thereon, to be rotated in order to move the blocking member 208 within the helical slot 206 of the housing 202.

The annular rib 226*a* at the split tip of the stem 222 forms an annular abutment engageable with an annular shoulder 227 in the housing adjacent the inlet opening 204. Rib 226*a* permits rotational movement, but not axial movement, of stem 222 within the housing. The split tip 226 is formed with an outer tapered surface permitting the stem to be inserted with a snap-fit into the axial bore defined by the housing 202.

Stem assembly 210 is further formed with a threaded, axially-extending bore 230 for receiving an externally-threaded pin 232. The inner end of pin 232 is formed with an enlarged head 236 to be located adjacent to the throat 204*a* of the sprinkler inlet 204. The opposite (outer) end of pin 232 is formed with a screwdriver slot 233. Head 236 of pin 232 thus serves as a flow-control element which is movable, upon rotation of pin 232, towards or away the inlet throat 204*a* for presetting the size of the inlet opening, and thereby the rate of flow of the water therethrough to the sprinkler and the range of the sprinkler.

As particularly seen in FIG. 1, both the upper surface 206*a* and the lower surface 206*b* of the helical slot 206 are tapered outwardly to produce an upwardly-inclined spray-pattern of the water discharged through the helical slot 206. In addition, the upper surface 206*a* of the helical slot is formed with a plurality of radially-extending ribs 240 which tend to direct the discharged water to the radial direction thereby increasing the range of the water discharge, and also to move the water discharge more uniformly over the preselected sector.

The sprinkler, insofar as described above, is generally the same as described in my U.S. Pat. No. 5,205,491 which description is hereby incorporated by reference. In the sprinkler described in that application, the blocking member 208 is formed with an outer rib (therein designated 20) extending helically around its circumference and of a configuration corresponding to that of helical slot 206 so as to be snugly receivable and movable within that slot for preselecting the portion of the slot to be unblocked, and thereby the sector angle of the water distribution around the sprinkler.

In the arrangement illustrated in the drawings of the present application, the inner face of housing section 202*a* is formed with a helical recess 250 for receiving a helical rib 252 formed in the outer face of the blocking member 208. Below helical rib 252, the blocking member 208 is formed with a cylindrical surface 254 having an outer diameter substantially equal to the diameter of the part 211*a* of bore 211 communicating with slot 206. Cylindrical surface 254 terminates in a lower edge 256 which is cut at a bias or angle with respect to the longitudinal axis of the housing 202. Thus, the two ends 256*a* and 256*b* of the lower edge 256 are axially offset with respect to each other.

The arrangement is such that the cylindrical surface 254 of blocking member 208 engages, and is flush with, the inner surface of the housing 202 on opposite sides of its helical slot 206 so as normally to block the slot from discharging water therethrough. However, as the blocking member 208 is rotated by manually rotating collar 224 of the stem assembly 210, the blocking member 208 is also, at the same time, moved axially by its helical rib 252 moving within the helical slot 250 of the housing 202, such that the lower edge 256 of the blocking member unblocks slot 206 according to the rotated position of the blocking member.

The lower end of housing section 202*b* is externally threaded for attaching the sprinkler to a vertical riser.

The sprinkler is assembled as follows:

Blocking member 208 is inserted between the two housing sections 202*a*, 202*b*, and then the two housing sections are secured together by inserting posts 212 of section 202*a* into openings of section 202*b*. The two sections may be secured detachably by a friction fit, or permanently by adhesive or heat-welding.

Stem assembly 210 is then inserted through bore 211 of the housing, and through bore 218 of the blocking member 208. This insertion is facilitated by the flexibility of the split tip 226 and by its outer tapered surface, which permits the assembly to be inserted with a snap-fit with the annular rib 226*a* engaging annular surface 227 of the housing. Pin 232 is then threaded into stem 222 from its bottom.

The assembled two housing sections 202*a*, 202*b*, with the blocking member 208, stem assembly 210 and pin 232 in between, are then attached to the lower housing section 202*c* by press-fitting the outer smooth surface 216 in the latter section within the internal smooth surface of section 202*b*.

The sprinkler may then be preset to provide the desired sector of water-distribution, and also the desired rate of water distribution, as follows:

To preset the rate of water distribution, a screwdriver or other tool is inserted into the outer slot 233 of pin 232 and rotated to rotate the pin. This moves head 236 at the opposite end of the stem assembly 210 towards or away from throat 204*a* of the inlet opening 204.

To preset the sector, collar 224 is rotated, which thereby rotates blocking member 208. Rotating the blocking member causes its helical rib 252 to move within the helical groove 250 of the housing 202, such that the lower edge 256 of the blocking member moves both rotatably and axially to block or unblock slot 206 according to the direction and amount of rotation of the blocking member. Thus, the portion of slot 206 not blocked by the lower edge 256 of the blocking member determines the sector angle of the water distribution around the sprinkler.

It has been found that the arrangement illustrated in the drawings effectively prevents leakage or discharge of water from the helical slot 206 except via the unblocked portion of that slot.

While the invention has been described with respect to one preferred embodiment, it will be appreciated that many other variations, modifications and applications of the invention may be made.

What is claimed is:

1. A static, sector-type water sprinkler producing a variable-sector water-distribution pattern, comprising:

a housing formed with an inlet opening at one end connectible to a supply of pressurized water, an outlet opening having an effective length around the circumference of the housing which may be varied for preselecting the sector angle of the water distribution around the sprinkler, and a bore connecting said inlet opening and outlet opening;

said outlet opening being defined by a slot formed through said housing in communication with a part of said bore and extending helically around substantially the complete circumference of the housing at said part of the bore;

and a blocking member received within said part of the bore and movable with respect to said slot to preselect the portion thereof to be unblocked by said blocking member, and thereby the sector angle of the water distribution around the sprinkler;

characterized in that said blocking member includes an outer face formed with a cylindrical surface having an outer diameter substantially equal to the diameter of said part of the bore so as to be engageable with the inner surface of said housing on opposite sides of said slot to preselect the portion thereof to be unblocked by the blocking member and thereby the sector angle of the water distribution around the sprinkler.

2. The sprinkler according to claim 1, wherein said blocking member is rotatable with respect to said housing to preselect the portion of the slot to be unblocked by the blocking member.

3. The sprinkler according to claim 2, wherein said blocking member is further formed with a helical rib receivable in a helical slot in the inner surface of the housing and effective to move an edge of said cylindrical surface of the blocking member over the inner surface of said housing on opposite sides of said helical slot to thereby preselect the portion of the helical slot to be unblocked by said blocking member.

4. The sprinkler according to claim 3, wherein said edge of the blocking member effective to preselect the portion of said first-mentioned helical slot to be unblocked is angled with respect to the longitudinal axis of said housing and has axially offset ends.

5. The sprinkler according to claim 1, wherein said slot is interrupted by a plurality of posts joining together the portions of the housing on the opposite sides of the slot, all of said posts together occupying an angular length which is at least one order of magnitude smaller than the circumference of the housing.

6. The sprinkler according to claim 1, wherein said blocking member is formed with a non-circular bore extending axially thereof, and said sprinkler includes a non-circular stem extending through said non-circular bore and having an externally-accessible finger-gripping element to facilitate manual rotation of said blocking member in order to preselect the sector angle of the water distribution around the sprinkler.

7. The sprinkler according to claim 6, wherein said externally-accessible finger-gripping element is a circular collar fixed to one end of said stem, the opposite end of the stem being formed with an annular abutment engageable with an annular shoulder formed on the housing adjacent to said inlet opening, permitting rotational movement, but not axial movement, of said stem within said housing.

8. The sprinkler according to claim 7, wherein said annular abutment formed at said opposite end of the stem is defined by a split annular rib formed with an outer tapered surface permitting said stem to be inserted with a snap-fit into said bore of the housing.

9. The sprinkler according to claim 7, wherein said opposite end of the stem carries a flow control element adjacent the inlet opening of the housing and presettable towards and away therefrom to preset the size of the inlet opening and thereby the rate of flow of the water therethrough.

10. The sprinkler according to claim 9, wherein said flow control element is carried by an externally-threaded pin received in an internally threaded bore formed in said stem and accessible from said one end of the stem for presetting the position of the flow control element.

11. The sprinkler according to claim 10, wherein said flow control element is in the form of an enlarged head carried by the end of said externally-threaded pin at said opposite end of the stem.

12. The sprinkler according to claim 1, wherein a portion of said housing formed with said helical slot includes a first section formed with one surface of said slot, and a second section formed with the other surface of said slot; said first section being further formed with a plurality of circumferentially-spaced posts fixed within bores formed in said second section.

13. The sprinkler according to claim 1, wherein a portion of the housing defining an upper surface of said helical slot is formed with a plurality of radially-extending ribs.

14. A static, sector-type water sprinkler producing a variable-sector water-distribution pattern, comprising:

a housing formed with an inlet opening at one end connectible to a supply of pressurized water, and an outlet opening having an effective length around the circumference of the housing which may be varied for preselecting the sector angle of the water distribution around the sprinkler;

said outlet opening being defined by a first helical slot extending through said housing for substantially its complete circumference;

and a blocking member having an outer face formed with a cylindrical surface movable with respect to said slot to preselect the portion thereof to be unblocked by the blocking member;

said cylindrical surface of the blocking member being formed with an edge having axially offset ends;

said blocking member being further formed with a helical rib receivable in a second helical slot in an inner face of the housing effective, when said blocking member is rotated with respect to said housing, to move said edge over an inner face of said first helical slot to preselect the portion thereof to be unblocked by said edge, and thereby the sector angle of the water distribution around the sprinkler.

15. The sprinkler according to claim 14, wherein said first helical slot is interrupted by a plurality of posts joining together the portions of the housing on the opposite sides of the slot, all of said posts together occupying an angular length which is at least one order of magnitude smaller than the circumference of the housing.

16. The sprinkler according to claim 14, wherein said blocking member is formed with a non-circular bore extending axially thereof, and said sprinkler includes a non-circular stem extending through said non-circular bore and having an externally-accessible finger-gripping element to facilitate manual rotation of said blocking member in order to preselect the sector angle of the water distribution around the sprinkler.

17. The sprinkler according to claim 16, wherein said externally-accessible finger-gripping element is a circular collar fixed to one end of said stem, the opposite end of the stem being formed with an annular abutment engageable with an annular shoulder formed on the housing adjacent to said inlet opening, permitting rotational movement, but not axial movement, of said stem within said housing.

18. The sprinkler according to claim 17, wherein said annular abutment formed at said opposite end of the stem is defined by a split annular rib formed with an outer tapered surface permitting said stem to be inserted with a snap-fit into said housing.

19. The sprinkler according to claim 17, wherein said opposite end of the stem carries a flow control element adjacent the inlet opening of the housing and presettable towards and away therefrom to preset the size of the inlet opening and thereby the rate of flow of the water therethrough.

20. The sprinkler according to claim 14, wherein a portion of the housing defining an upper surface of said first helical slot is formed with a plurality of radially-extending ribs.

* * * * *